United States Patent [19]

Mishima et al.

[11] Patent Number: 4,531,977

[45] Date of Patent: Jul. 30, 1985

[54] PROCESS FOR PRODUCING SUPERPLASTIC ALUMINUM ALLOY STRIPS

[75] Inventors: Ryoji Mishima, Yokohama; Hitoshi Miyamoto, Kawasaki, both of Japan

[73] Assignee: Kasei Naoetsu Light Metal Industries, Ltd., Tokyo, Japan

[21] Appl. No.: 483,951

[22] PCT Filed: Jul. 28, 1982

[86] PCT No.: PCT/JP82/00292

§ 371 Date: Mar. 28, 1983

§ 102(e) Date: Mar. 28, 1983

[87] PCT Pub. No.: WO83/00510

PCT Pub. Date: Feb. 17, 1983

[30] Foreign Application Priority Data

Jul. 30, 1981 [JP] Japan ..... 56-119900

[51] Int. Cl.[3] ..... C22F 1/04

[52] U.S. Cl. ..... 148/2; 148/11.5 A; 420/902

[58] Field of Search ..... 148/2, 11.5 A, 12.7 A; 420/902

[56] References Cited

FOREIGN PATENT DOCUMENTS 48-28310 4/1973 Japan .
52-63111 5/1977 Japan .

OTHER PUBLICATIONS

Metallurgical Transactions A, vol. 6A, Mar. 1975, pp. 591–594.
Metal Science, Jul. 1976, pp. 235–242.

*Primary Examiner*—R. Dean
*Attorney, Agent, or Firm*—Cushman, Darby & Cushman

[57] ABSTRACT

Process for producing superplastic aluminum alloy strips comprising continuously casting and rolling a molten aluminum alloy containing 4.0 to 6.0% (by weight) of magnesium, 0.4 to 1.5% (by weight) of manganese, 0.05 to 0.2% (by weight) of chromium and less than 0.50% (by weight) of silicon, thereby preparing a cast strip of 3 to 20 mm in thickness, after subjecting the cast strip to annealing treatment at a temperature of 420° to 530° C., subjecting the annealed strip to the former step of cold rolling and intermediate annealing and then subjecting the intermediately annealed strip to the latter step of cold rolling until the reduction ratio reaches to a value of not less than 60%.

5 Claims, No Drawings

PROCESS FOR PRODUCING SUPERPLASTIC ALUMINUM ALLOY STRIPS

DESCRIPTION

1. Technical Field

The present invention relates to a process for producing superplastic aluminum alloy strips. Particularly, the present invention relates to a process for easily producing superplastic aluminum alloy strips on an industrial scale.

2. Background Art

Metals or alloys which can be elongated to an abnormal extent of hundreds to thousand percents without generating local deformation (necking) when a mechanical force is externally applied thereon have been known as superplastic metals or superplastic alloys. In superplastic aluminum alloys, two types of extra fine recrystallized grains type alloy and fine eutectic structure type alloy are known.

Extra fine recrystallized grains type alloy is obtained by annealing a cold-rolled alloy strip to generate recrystallized grains, where some control measure is taken to make the newly recrystallized grains fine. Also, fine eutectic structure type alloy is obtained by retaining the fine eutectic (mixture phase) structure obtained in the casting step with some control measure to make the structure finer, up to the rolled strip.

In both of superplastic aluminum alloys, the structure thereof consists of extra-fine crystal grains of from 0.5 micrometer or less to a maximum of 10 micrometers in diameter, and the plastic deformation of such a material is easily effected by the smooth grain boundary migration or sliding. In superplastic aluminum alloy of extra fine recrystallized grains type, it is necessary to add specific elements thereinto for preventing the growth of the grains to be larger and coarser. In many cases, transition elements are used as an additive element showing such effect. Further, in the case where a successive deformation is caused to superplastic alloy, a work hardening occurs within the crystal grains and the plastic deformation becomes difficult in time. In order to reduce the tendency of the work hardening, it has also been known to add elements such as copper, magnesium, zinc and the like in addition to the transition elements. Such elements have a function of causing a dynamic recrystallization, that is, a recrystallization which is simultaneously caused with the deformation of the material and constantly regenerates the original structure of the material before deformation.

Formerly, the present inventors have proposed a process for producing aluminum alloy strips of remarkably improved superplasticity, comprising cold rolling the aluminum alloy strips after annealing the aluminum alloy strips produced by continuously casting and rolling a molten aluminum alloy containing magnesium, manganese and chromium (refer to Japanese Patent Application No. 56-36268). Although the process is excellent as a process for producing superplastic aluminum alloy strips, since the aluminum alloy strips cause the work hardening in process of cold rolling, the rolling of the strip gradually becomes difficult with the raise of the reduction ratio.

The present invention provides a method for removing the difficulty caused by this work hardening.

DISCLOSURE OF INVENTION

The characteristic of the present invention is a process for producing strips of superplastic aluminum alloys, comprising continuously casting and rolling a molten aluminum alloy containing 4.0 to 6.0% (by weight) of magnesium, 0.4 to 1.5% (by weight) of manganese, 0.05 to 0.2% (by weight) of chromium and less than 0.50% (by weight) of silicon, thereby obtaining a cast strip of 3 to 20 mm in thickness, after subjecting the thus obtained strip to annealing treatment at a temperature of 420° to 530° C., subjecting the thus treated strip to the former step of cold rolling and the intermediate annealing and subjecting the intermediately annealed strip to the latter step of cold rolling until the reduction ratio reaches to a value of not less than 60%, and the thus produced strip of the aluminum alloy shows an excellent superplasticity at a temperature of higher than 300° C., particularly, at a temperature of higher than 400° C.

BEST MODE OF CARRYING OUT THE INVENTION

The present invention will be explained more in detail as follows.

It is necessary that the aluminum alloy for use in the present invention contains 4.0 to 6.0% (by weight) of magnesium, 0.4 to 1.5% (by weight) of manganese and 0.05 to 0.2% (by weight) of chromium.

As has been stated, magnesium is an element effective in causing dynamic recrystallization or the restoration of the structure. The more magnesium is contained therein, the more effective and it is necessary that the content of magnesium is at least 4%. However, in the case where the content thereof is higher than 6%, coarse particles of $\beta$-phase (Mg-Al compound) crystallize out on the grain boundaries and make the cold rolling difficult. Manganese and chromium have a function of impeding the growing coarse of the recrystallized grain. The amount of addition of manganese is not more than 1.5%, that is, in the range in which manganese can almost form solid solution at the time of casting. However, the amount of addition of less than 0.4% is insufficient for exhibiting its effect. In the case where manganese is added in an amount more than that which can form a solid solution at the time of casting, coarse crystals appear in the casting step. These crystals are not only ineffective to the fining of the recrystallized grains but also adversely affect cold rolling. Chromium is also apt to form a coarse compound with manganese in the case where the content therein becomes higher than 0.2%, and the fining effect of manganese and chromium disappears. On the other hand, its effectiveness is slightly exhibited in the case where its content therein is less than 0.05%.

Into the aluminum alloy used in the present invention, other transition elements, for instance, zirconium, which do not lower the effect of the above mentioned additive elements, may be added. Also, a minute amount of titanium and boron may be added thereto as usual with the intention of fining the crystal grain. Further, the presence of impurities contained in ordinary aluminum alloys such as iron, copper and the like may be harmless as far as the content thereof is in the ordinarily allowable range, that is, not more than 0.40%, particularly not more than 0.20% of iron, and not more than 0.10% of copper.

Concerning the presence of silicon which is also an ordinary impurity in aluminum alloy as well as iron, it is allowable at a content of less than 0.50%. In the aluminum alloy used in the present invention, the presence of a certain amount of silicon causes the dynamic recrystallization similarly to magnesium, in other words, causes recrystallization simultaneously with plastic deformation of the superplastic alloy strips and have a function of regenerating the structure prior to deforming. In addition, silicon forms a compound ($Mg_2Si$) with magnesium, the thus formed compound composes fine particles phase and then contributes to the exhibition of superplasticity. Furthermore, silicon has effects of increasing fluidity of the molten alloy in the time of casting, of preventing the seggregation of components, which is apt to occur in the central layer of the cast strip, and of securing good superplastic performance. Since the content of silicon in the commercial primary aluminum is not more than 0.25%, in order to exhibit the effects mentioned above, it is preferable to add silicon positively. However, too much addition of silicon is apt to cause the seggregation of components in the surface of the cast strip and accordingly, the upper limit of the content of silicon should be less than 0.50%. The preferable content of silicon is 0.25 to 0.45%.

In the process according to the present invention, a molten aluminum alloy of the composition mentioned above is continuously cast and rolled to produce directly a long cast strip of 3 to 20 mm, preferably 4 to 15 mm, in thickness. The process for continuous casting and rolling has been well known, and several processes such as Hunter's process, 3C process, Hazelett's process and the like have been known. According to the known continuous casting and rolling processes, a nozzle is installed between a driving mould which consists of two rotating rolls for casting or running belts for casting, and a molten alloy is introduced into the mould through the nozzle and is rolled to form a cast strip while cooling by the mould. According to this process, since the amount of manganese and chromium in the solid solution increases in the casting, the intermetallic compounds containing manganese and chromium scarcely crystallize out when the additive amount of these metals is in the above-mentioned range, and it is possible to remarkably improve the effect of fining of the recrystallized grains by combining the successive heat treatment. It is suitable that the speed of continuous casting and rolling (the linear velocity of the cast strip) is 0.5 to 1.3 m/min and the temperature of the molten alloy is 680° to 730° C.

The thus obtained cast strip is subjected to an annealing treatment at a temperature of 420° to 530° C. It is suitable that the period of annealing is 6 to 24 hours. Lower temperature necessitates longer time period, and on the other hand, shorter time period is sufficient at higher temperature as a usual thermal treatment. By this annealing, it is possible to bring the magnesium which has crystallized out during casting into uniformly dissolved state and to improve the effect of magnesium on dynamic recrystallization. In addition, it is possible to make manganese and chromium, which have become supersaturated in a solid solution, precipitate as uniform and extra fine precipitates which are effective in preventing the grain boundary migration of recrystallized grains.

In the case where the annealing temperature is lower than 420° C., it is impossible to make magnesium sufficiently dissolve and make manganese and chromium effectively precipitate. On the other hand, in the case of over 530° C., since the amount of precipitated manganese and chromium reduces and the precipitates become coarser, the effect of preventing the grain boundary migration is quite reduced. The suitable annealing temperature depends on the content of silicon in the cast strip of aluminum alloy and in general, it is preferable to use a lower temperature in the cases of larger content of silicon. For instance, in the case of the content of silicon of 0.25 to 0.45%, it is preferable to adopt the annealing temperature of 420° to 500° C., and in the case of the content of silicon of not more than 0.25%, it is preferable that the annealing temperature is 470° to 530° C., particularly 490° to 510° C.

The thus annealed cast strip is subjected to cold rolling without preceding hot rolling. By this procedure, it is possible to retain the state of extra fine precipitates of the additive elements which has been obtained by the annealing and to produce aluminum alloy strips showing excellent superplasticity. If hot rolling is carried out after annealing treatment, it is impossible to retain the state of extra fine precipitates of the additive elements and the superplastic characteristics of the obtained aluminum alloy strips are impaired.

According to the process of the present invention, cold rolling is carried out in two stages of the former stage and the latter stage. Between the two stages, an intermediate annealing is applied to the strip. The object of the intermediate annealing is to soften the strip which has been work-hardened by the cold rolling in the former stage and to facilitate the cold rolling in the latter stage. In the intermediate annealing, the softening proceeds with the raise of the annealing temperature and particularly, the softening markedly proceeds in the range of 200° to 250° C. The softening reaches substantially to saturation at 250° C. and an elevation of the extent of softening is relatively small even if the strip is heated to higher temperatures. In addition, in the case of excessive high temperature, the precipitates in the alloy strip become coarser and the superplastic characteristics of the strip are impaired. Accordingly, it is ordinarily preferable to carry out the intermediate annealing at 250° to 400° C. It is also preferable to adopt shorter time period for the intermediate annealing and it is ordinarily of one to four hours.

In the process of the present invention, the cold rolling is carried out in two stages of the former stage and the latter stage and it is necessary that the reduction ratio in the latter stage of cold rolling is not less than 60%. In the case where the reduction ratio in the latter stage is less than 60%, it is difficult to obtain strips showing excellent superplasticity. The preferable reduction ratio in the latter stage is not less than 65% and in general, the superplasticity of the rolled strip becomes more excellent as the reduction ratio is higher. However, the rolling becomes more difficult due to the work hardening in the case of excessively high reduction ratio and accordingly, the reduction ratio in the latter stage is determined while taking account of the desired superplasticity of the rolled strips. Generally, the reduction ratio in the latter stage is preferably not more than 80%.

If the total reduction ratio and the reduction ratio in the latter stage are represented by K and $K_2$, the reduction ratio $K_1$ in the former stage is represented by the following equation.

$$K_1 = \frac{K - K_2}{1 - K_2}$$

In general, the reduction ratio of the former stage is set to be not less than 30%. In cases where the reduction ratio of the former stage is lower than 30%, the effect of the intermediate annealing is small. The preferable reduction ratio of the former stage is 30 to 60%. In the case where the reduction ratio of the former stage is higher than 60%, an additional intermediate annealing is preferably applied thereto in the way of the former stage rolling for removing the work hardening and then the rolling in the former stage is continued. Rolling itself is carried out according to the conventional method both in the former stage and in the latter stage.

Subsequently, the present invention will be explained more in detail based on the following examples and the present invention is not limited by the following examples as far as not exceeding the subject matters thereof.

EXAMPLES 1 TO 5

Each of the aluminum alloys having the respective compositions shown in Table 1 (0.14% of iron and not more than 0.01% of copper were contained as the impurities and the amount of the other impurities was not more than 0.02% in total) was melted in a gas furnace and degassed sufficiently at a temperature of 750° C. in the molten alloy. A master alloy containing 5% of titanium and 1% of boron was added into the molten alloy to make the content of titanium therein 0.03%. The molten alloy mentioned above was continuously cast and rolled by using a driving mould constituted by two water-cooled rolls of 30 cm in diameter while supplying the molten alloy at 730° C. and at a casting speed of 100 cm/min to produce cast strips of 6.6 mm in thickness.

These cast strips were annealed for 6 hours at 510° to 520° C. (in Examples 1 to 2) or for 12 hours at 470° to 480° C. (in Examples 3 to 5) and then were subjected to cold rolling to obtain the alloy strips of 3.3 mm in thickness (at a reduction ratio of 50%). These strips were subjected to the intermediate annealing at 350° C. for 2 hours. In the Examples 1 and 2, the tensile strength of the strips were 42.5 kg/mm$^2$ before intermediate annealing and after intermediate annealing, the tensile strength of the alloy strips was 31.5 kg/mm$^2$.

These were further subjected to the latter stage of cold rolling up to 1.4 mm in thickness (a total reduction ratio of 79% and a reduction ratio in the latter stage of cold rolling of 58%) and 1.0 mm in thickness (a total reduction ratio of 85% and a reduction ratio in the latter stage of cold rolling of 70%).

Test pieces (25 mm in length of parallel part and 10 mm in width of parallel part) from each of the rolled strips thus produced were cut out following the JIS Z 2201 (method for preparing specimens of metal for tensile tests). These test pieces were subjected to tensile test for the elongation at break and the maximum stress following the indication of JIS Z 2241 (method for carrying out tensile tests) with the distance of 25 mm between the two index points and under the test temperatures and the initial strain rates shown in Table 2.

The results are shown in Table 2.

TABLE 1

| Alloy | Composition (%) | | | | |
|---|---|---|---|---|---|
| | Mg | Mn | Cr | Si | Al |
| A | 4.5 | 0.73 | 0.14 | 0.08 | Balance |
| B | 5.5 | 0.51 | 0.14 | 0.06 | Balance |
| C | 5.4 | 0.51 | 0.14 | 0.30 | Balance |
| D | 5.5 | 0.51 | 0.14 | 0.44 | Balance |

TABLE 2

| Example No. | Alloy | Thickness of rolled strips (mm) | Temperature of test (°C.) | Initial strain rate (l/sec) | Elongation at break (%) | Maximum stress (kg/mm$^2$) |
|---|---|---|---|---|---|---|
| 1 | A | 1.4 | 530 | $1.3 \times 10^{-3}$ | 457 | 0.55 |
| 2 | A | 1.0 | 530 | $1.3 \times 10^{-3}$ | 592 | 0.44 |
| 3 | B | 1.0 | 520 | $2.5 \times 10^{-3}$ | 461 | 0.47 |
| | | | 500 | $2.5 \times 10^{-3}$ | 439 | 0.56 |
| 4 | C | 1.0 | 520 | $2.5 \times 10^{-3}$ | 662 | 0.42 |
| | | | 500 | $2.5 \times 10^{-3}$ | 685 | 0.50 |
| 5 | D | 1.0 | 520 | $2.5 \times 10^{-3}$ | 749 | 0.39 |
| | | | 500 | $2.5 \times 10^{-3}$ | 654 | 0.48 |

INDUSTRIAL APPLICABILITY

The aluminum alloy strips produced according to the process of the present invention show excellent superplasticity at a temperature of higher than 300° C., particularly higher than 400° C. Accordingly, the strips can be formed by various processing methods generally applied to the superplastic materials. The representative methods among them are the vacuum forming wherein a female mould is used and the material is closely adhered to the female mould by fluid pressure, and the bulging. In the forming process, it is preferable to adopt the strain rate in the range of $1 \times 10^{-3}$ to $1 \times 10^{-1}$/sec and the elongation in the range of 100 to 500%.

We claim:

1. A process for producing a strip of a superplastic aluminum alloy, comprising the steps of:

(a) continuously casting and rolling a molten aluminum alloy consisting essentially of 4.0 to 6.0% (by weight) of magnesium, 0.4 to 1.5% (by weight) of manganese, 0.05 to 0.2% (by weight) of chromium and less than 0.50% (by weight) of silicon thereby preparing a cast strip of 3 to 20 mm in thickness;

(b) annealing the cast strip at a temperature of 420° to 530° C.;

(c) subjecting the annealed strip to a first stage of cold rolling and intermediate annealing; and (d) then subjecting the intermediately annealed strip to a second stage of cold rolling until the reduction ratio reaches a value of not less than 60%.

2. A process as set forth in claim 1, wherein the cold rolling in the first stage is carried out until the reduction ratio reaches a value of 30 to 60%.

3. A process as set forth in claim 1 or claim 2, wherein the intermediate annealing is carried out at 250° to 400° C.

4. A process as set forth in claim 1 or claim 2, wherein the molten aluminum alloy contains 0.25 to 0.45% (by weight) of silicon and the annealing treatment after casting and rolling is carried out at 420° to 500° C.

5. A process as set forth in claim 1 or claim 2, wherein the molten aluminum alloy contains less than 0.25% (by weight) of silicon and the annealing treatment after casting and rolling is carried out at 470° to 530° C.

* * * * *